United States Patent [19]

Castel et al.

[11] Patent Number: 4,541,755

[45] Date of Patent: Sep. 17, 1985

[54] DEVICE AND PROCESS FOR LOWERING AND CONNECTING THE FOUR GUIDE LINES TO GUIDE POSTS OF AN UNDERWATER STATION

[75] Inventors: Yvon Castel; Michel Iato, both of Pau, France

[73] Assignee: Societe Nationale Elf Aquitaine (Production) Tour Aquitaine, Paris, France

[21] Appl. No.: 503,331

[22] Filed: Jun. 10, 1983

[30] Foreign Application Priority Data

Jun. 25, 1982 [FR] France ..... 82 11135

[51] Int. Cl.[4] ..... E21B 33/035

[52] U.S. Cl. ..... 405/195; 166/341; 405/168

[58] Field of Search ..... 405/195, 168–171; 166/338–348

[56] References Cited

U.S. PATENT DOCUMENTS

| | | | |
|---|---|---|---|
| 3,062,287 | 11/1962 | Hayes | 166/362 X |
| 3,179,176 | 4/1965 | Goepfert | 166/360 X |
| 3,236,302 | 2/1966 | Postlewaite | 166/341 |
| 3,313,347 | 4/1967 | Crain | 166/360 |
| 3,347,312 | 10/1967 | Neilon | 166/341 X |
| 3,503,442 | 3/1970 | Dodd et al. | 166/349 X |

FOREIGN PATENT DOCUMENTS

| | | |
|---|---|---|
| 2009179 | 5/1969 | France . |
| 2377517 | 8/1978 | France . |

*Primary Examiner*—Dennis L. Taylor

*Attorney, Agent, or Firm*—Poms, Smith, Lande & Rose

[57] ABSTRACT

Operations for returning to an underwater station equipped with a well apparatus.

The device comprises a rectangular frame formed by tubes 1 and at the four corners of which are fixed vertical fixed tubes 2. Four diagonally disposed radial arms 4 extend from each corner and are fixed to tubes 2. In the longitudinal axis of the frame there is fixed to the arms 4 a well head connector 6 carried by a train of rods 7. One of the arms 4 carries a funnel 8 for guiding the frame. Inside tubes 2 are slidably placed weighted tubes, 11, whose upper part has a shoulder 13, inside which comes to bear an olive 14 crimped to a cable 12, which passes through tubes 2 and 11 and carries at its lower end a guide line connector 10 intended to be locked to a guide post 24.

With the device, four guide lines may be positioned and connected simultaneously without being hindered by the encumbrance around the well head.

10 Claims, 6 Drawing Figures

12
14
13
11
7
41
40
4
6
3
5
1
8
22
21
23
2
20
9
10
24

DEVICE AND PROCESS FOR LOWERING AND CONNECTING THE FOUR GUIDE LINES TO GUIDE POSTS OF AN UNDERWATER STATION

The present invention relates to a device for lowering and connecting four guide lines to guide posts installed on an underwater station, as well as a process for using such a device. During the operations carred out on underwater wells, it is often required to return to the underwater installation for carrying out service and maintenance operations, more especially the recovery or removal of certain well equipment and the installation of other well equipment.

Re-entry to such an installation is achieved by using one or more guide cables. In the system described in U.S. Pat. No. 4,095,649 issued June 20, 1978 in the name of the applicant, re-entry to an underwater installation is provided by causing a frame to slide along a guide line connected to a retractable guide column fixed to the underwater station, said frame being partially supported by guide cables to be installed and carrying complementary equipment for fixing to the well head.

Since lowering of the frame is effected by sliding a cylindrical element along the guide column, positioning of the four guide lines is not easy. An underwater station is often cluttered up with multiple equipment of a well head and, for this reason, the guide posts to which the guide lines are to be connected are not readily accessible. The lateral space available is such that it is not possible to have access thereto by means of diving bells or other heavy equipment.

The present invention provides a system for placing and connecting the four guide lines simultaneously during a single remote controlled operation, however much the well head may be encumbered.

The invention relates more particularly to a device for lowering and connecting the four guide lines to guide posts installed on an underwter station comprising well apparatus such as a guide column, a well head and four guide posts, whose upper ends are situated at a level substantially lower than that of the well head, adapted to be guided in its descent along the guide line secured to the guide column.

It is characterized in that it comprises a frame with four radial arms, one of which carries a guide funnel intended to slide along the guide line and comprising a roller adapted to cooperate with helical ramps of the guide column so as to allow angular orientation of the frame, whereas in the longitudinal central axis of the frame there is fixed to the radial arms a central connector adapted to be locked to the well head, the end of each arm being integral with a first tube, inside which is telescopically slidably mounted a second tube, the two tubes having passing therethrough a cable carrying at its end an orientatable connector, means for retaining the cable in the second tube, so that the second tube accompanies the cable in the downward movement of this latter and slides inside the first fixed tube, and means for operating said sliding movement.

According to a particularly advantageous embodiment, the means for retaining the cable in the second tube consist of an inner shoulder placed towards the upper end of the second tube, in which an olive crimped to the cable comes to bear.

In a first variant, the means for causing the second tube to slide in the first one consist in providing the second tube with a ballast, so that, when the tension of the cable is released, the second tube slides under the effect of its own weight.

In another variant, the means for causing the second tube to slide consist in firmly securing one of said tubes to the piston of a piston and cylinder arrangement and the other to the body of the cylinder, so that the second tube is held in a raised position, then slides under the effect of the piston and cylinder.

The invention also provides a process for lowering and positioning the four guide lines or cables by means of the above device, characterized in that the frame is lowered into the sea along the guide line by means of a train of rods fixed to the top of the central connector, the cables passing inside the tubes being stretched at a constant tension, so that the olives are applied against the inner shoulders provided in the second tubes, lowering is continued until the guide funnel of the guide line is engaged on the guide column and the frame is angularly orientated and until the central connector is positioned on the well head, the four connectors suspended from the cables then being situated at a distance above the upper ends of the guide posts, the four cables are lowered while releasing the tension thereof and, possibly, by operating the four piston and cylinder arrangements, until the connectors are positioned and locked to the guide posts.

Other features of the invention will appear from the following description of examples of applications illustrated by the drawings in which.

The device comprises a chassis in the form of a rectangular frame formed by beams or tubes fixed by welding at the four corners to four fixed vertical tubes 2. Oblique beams or tubes consolidate the connection between the frame and the tubes 2.

Four radial arms 4 disposed in the form of a cross extend diagonally from each corner and are welded to tubes 2 and supported by oblique beams or tubes 5.

Figure 1:
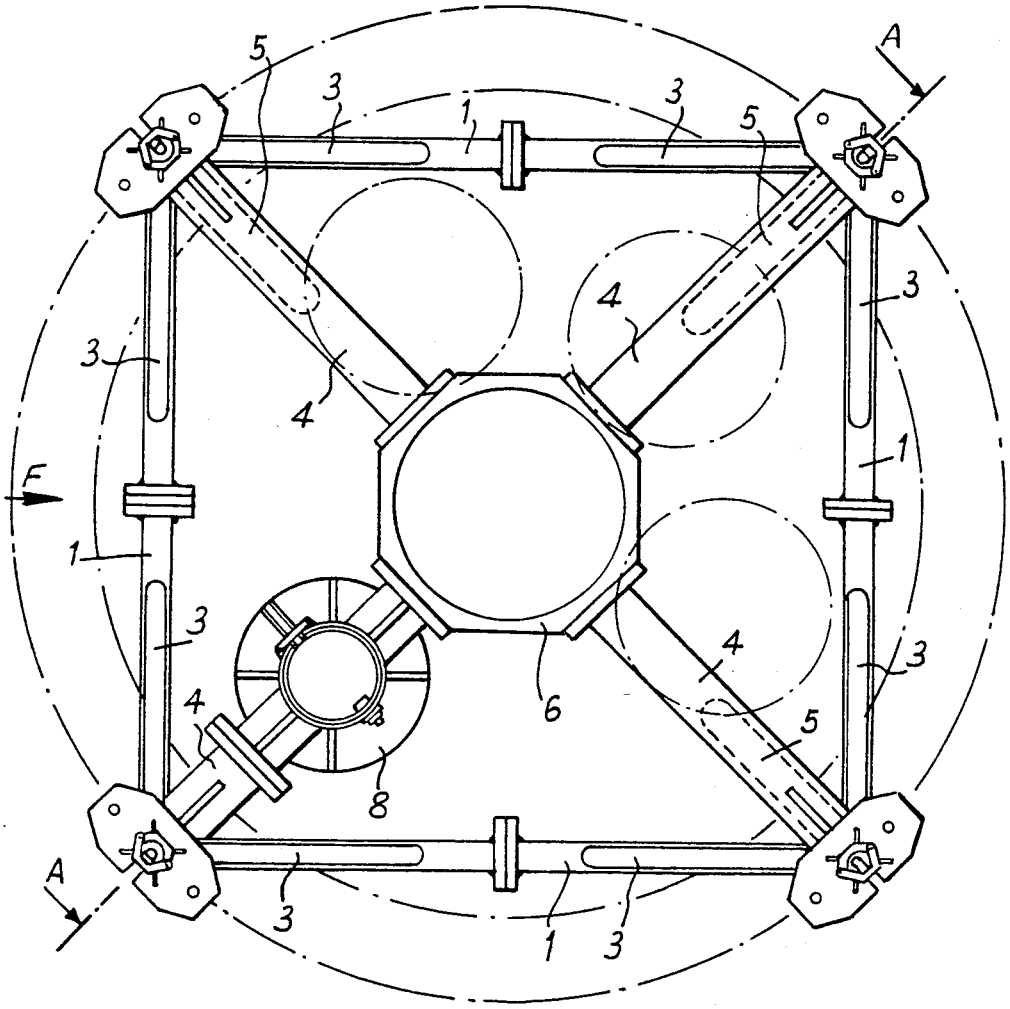
FIG. 1 shows a top view of the device.
Figure 2:
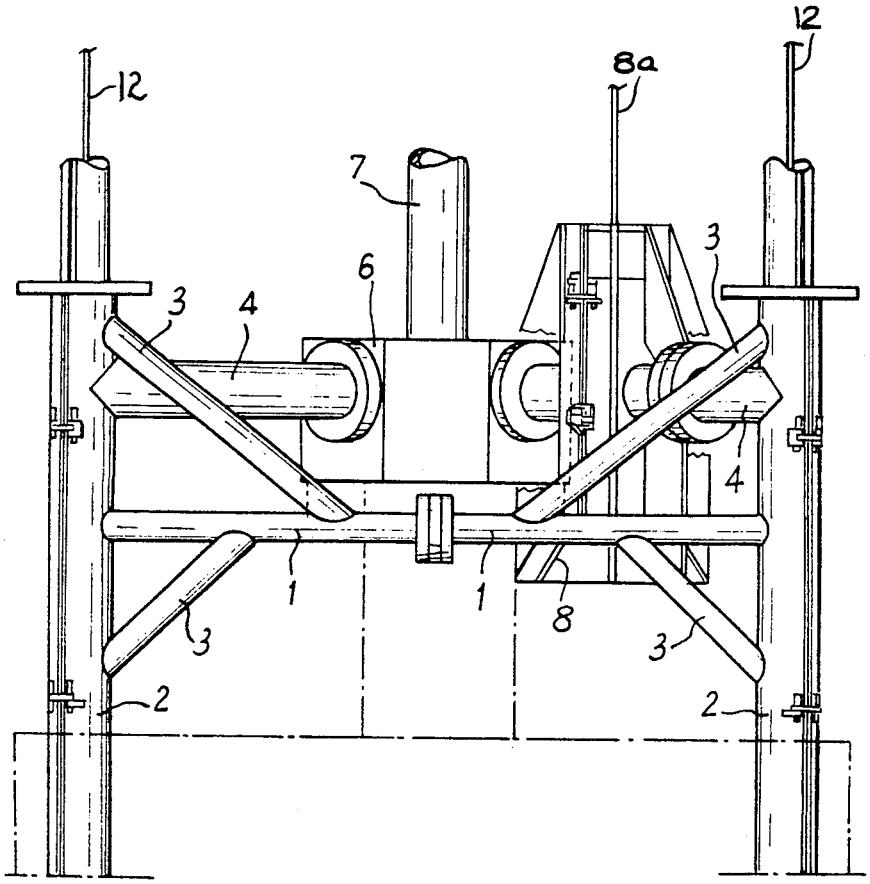
FIG. 2 shows an elevational view along F of FIG. 1.
Figure 3:
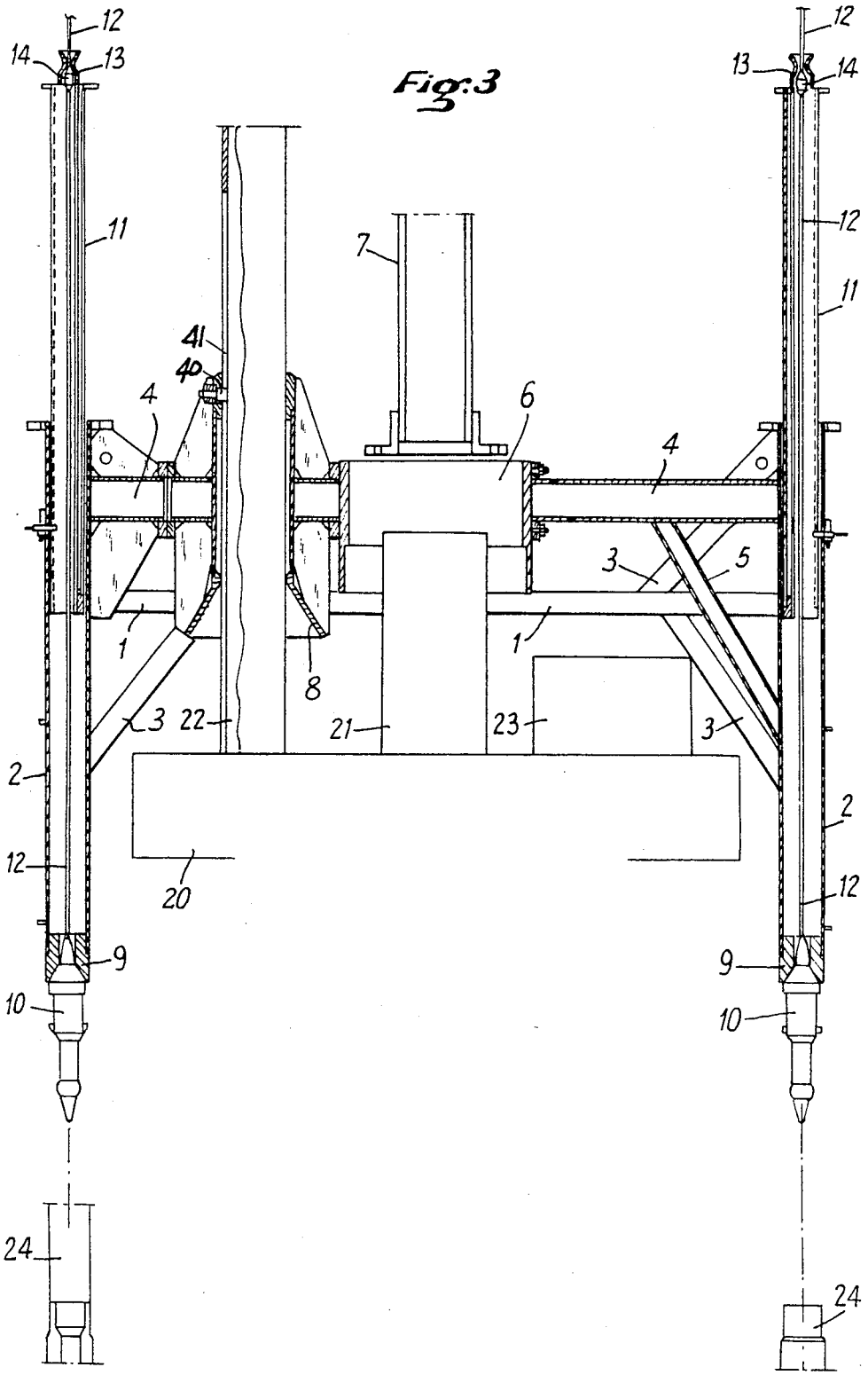
FIG. 3 is a sectional view along A—A of FIG. 1.

In the longitudinal axis of the frame there is fixed to the radial arms 4 a central connector 6 intended to be locked on the well head carried by a train of rods designated schematically at 7 (FIG. 3).

One of the four rods carries, between its ends, a guide funnel 8 for guiding the frame in its downward movement along a guide line previously installed on a guide column forming part of the equipment of the well head. The funnel 8 is associated with a guide assembly which is not shown which may be for example the one described in U.S. Pat. No. 4,095,649 issued June 20, 1978 in the name of the applicant, comprising means for angularly orientating the frame with respect to the position of the guide post, to which the four guide lines are to be fixed.

At the four corners of the rectangular frame are placed, solidly fixed to this frame, tubes 2 whose lower ends end in seats 9 of reduced section, for engaging the tube on connectors 10, for example of the type described in U.S. Pat. No. 4,400,112 issued Aug. 23, 1983 in the name of the applicant. Inside each tube 2 is placed another telescopically slidable tube 11, whose double wall is weighted with lead which weighs approximately 500 kg. At its upper part, tube 11 has a narrowed section with a shoulder 13, inside which may come to bear an olive 14 crimped to a cable 12 which, slid inside tubes 2 and 11 through a longitudinal slit 32 closed by a door 34 (FIGS. 4 and 6), passes there through and carries at its lower end connector 10.

In FIG. 3 has been shown schematically a base element 20 of the underwater station comprising a central well head 21, a guide column 22 and a mandrel 23, whereas guide posts 24 are installed at a level below the base element 20. It can be seen that the lower end of tube 2 is situated at a certain distance above the upper end of guide post 24, when the central connector 6 rests on the well head 21 and tube 11 is in the raised position.

The use of the device described is the following. A guide line not shown is stretched between a floating structure situated above the underwater station and the guide column 22.

Since tubes 2 and 11 have a longitudinal slit 32, the cables 12 are slid inside these tubes while taking care that the olives 14 are housed in the shoulders 13. The ends of cables 12 are fitted with connectors 10 so that they bear on the seats 9 present at the lower ends of tubes 2. The guide line 8*a* secured to the guide column 32 at the bottom of the sea is slid in funnel 8 and the frame is lowered along this line by means of the train of rods 7 fixed to the central connector 6 integral with the frame.

The tension of the cables is maintained constant at a value slightly above 500 kg in each cable, the purpose of which is to engage the olive 14 with the shoulder 13. Since the tensions in the cables are less than the weight of the frame, the rest of the weight is supported by the train of rods 7 serving for lowering and raising the frame. The weighted tubes 11 slidably mounted inside the fixed tubes 2 bear on cables 12 through olives 14 crimped to these cables and housed in the shoulders 13 of said tubes 11.

With the system incorporated in the funnel 8 allowing selective orientation of the frame with respect both to the well head 21 and to guide posts 24, the frame is orientated angularly as by rollers 40 engaged with groove 41 in guide column 22, or as exemplarily shown in U.S. Pat. No. 4,095,649, or in an appropriate fashion. When the connector 6 comes into engagement on the well head 21, the connectors 9 are in alignment above the guide posts 24. The tension of cables 12 is released and connectors 9 descend under the influence of the weight of the weighted tubes 10, penetrate inside guide posts 24 and are locked by means of the locking mechanism which they comprise.

Figure 4:
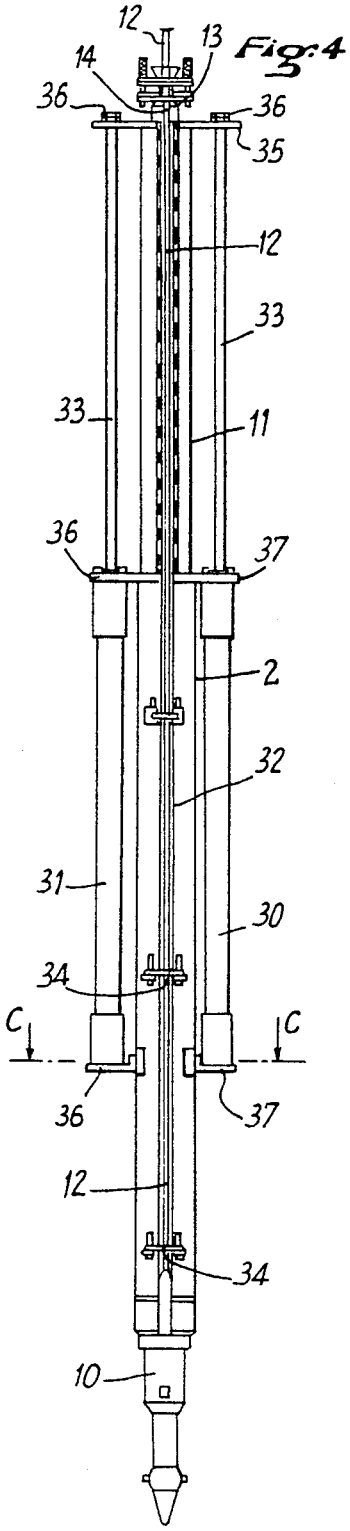
FIG. 4 is an elevational view of another embodiment.
Figure 5:
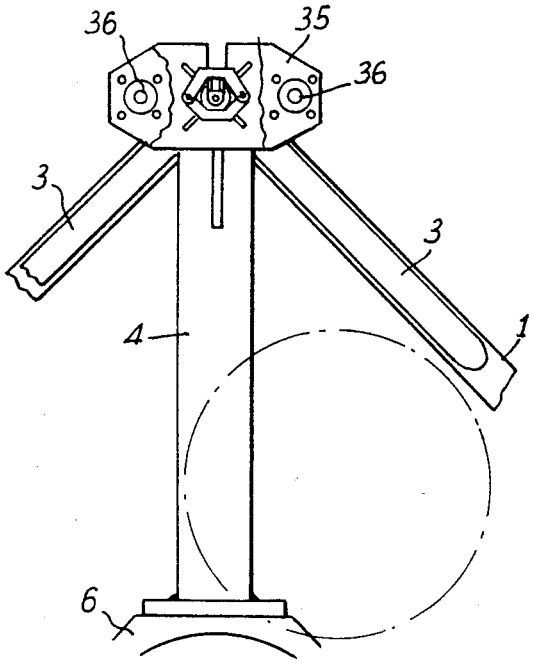
FIG. 5 is a top view of this embodiment.
Figure 6:
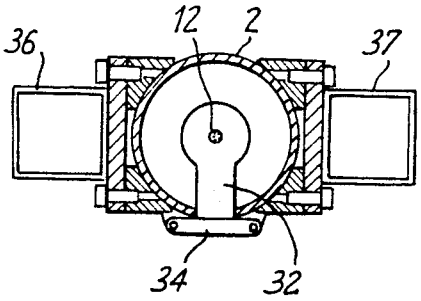
FIG. 6 is a sectional view along C—C of FIG. 4.

In a variant shown in FIGS. 4, 5 and 6, the tube sliding in the fixed tube 2 is not weighted. At its upper part, the cable is also retained by means of a crimped olive 13 housed in shoulder 13, so that the cable accompanies tube 11 in its downward movement. The sliding of tube 11 is provided by hydraulic cylinders. In the embodiment shown, between brackets 36 and 37 integral with the fixed tube 2 are fixed two cylinders 30 and 31, whereas the upper end of the pistons 33 is fixed to a plate 35 by means of screws 36, which plate is integral with the upper end of tube 11. Cable 12, which is slid inside the two tubes 2 and 11 through the slit 32 closed by doors 34 is retained at the upper end of tube 11. The operation using this variant is similar to the one already described. The tension of the cables is maintained at a constant value during the lowering and the second tube remains in a raised position through the action of the hydraulic cylinders. When the central connector 6 rests on the well head 21, the hydraulic cylinders 30 and 31 are actuated so as to cause the telescopic tube 11 to slide downwards taking with it cable 12, until the connectors 10 meet the guide posts 24.

The invention is not limited to the embodiments described above, numerous variations and adaptations may be made thereto without departing from the spirit of the invention. In particular, devices for retaining the cable in the sliding tube other than the olive housed in an inner shoulder may be used, as well as other arrangements of the frame and its equipment. For example, instead of providing the four sliding tubes with means for their downward movement, such as ballast or hydraulic cylinders, only two diagonally opposite tubes out of the four may be so provided.

We claim:

1. A device for lowering and connecting four guide lines to respective guide posts installed on an underwater station comprising a well apparatus having a guide column, a well head and four guide posts at said station whose upper ends are situated at a level substantially lower than that of the well head, the device being adapted to be guided in downward movement along a guide line secured to the guide column, characterized in that the device comprises a frame with four radial arms (4) one of which carries a guide funnel (8) adapted to slide along the guide line and comprising rollers (40) adapted to cooperate with helical ramps (41) of the guide column so as to allow angular orientation of the frame, whereas at a longitudinal axis of the frame a central connector (6) is fixed to the radial arms (4) and adapted to be locked to the well head (21), the end of each arm (4) being firmly secured to a first fixed tube (2), a second tube (11) telescopically slidable within said first fixed tube (2), the two tubes having passing therethrough a cable (12) carrying at its end an orientable connector (10), means for retaining the cable in the second tube (11), so that the second tube accompanies the cable in its downward movement and slides inside the first tube (2) as well as means for providing said sliding.

2. The device according to claim 1, characterized in that the means for retaining the cable in the second tube (11) includes an inner shoulder (13) placed towards the upper end of the second tube, in which shoulder is housed an olive (14) crimped to the cable (12).

3. The device as claimed in claim 1 characterized in that the means for causing the second tube (11) to slide in the first one (2) includes in providing the second tube with a weight, so that, when the tension of the cable is released, the second tube slides under the influence of its own weight.

4. The device according to claim 3, characterized in that in the raised position of the second tube (11), the olive (14) remains applied against the shoulder (13) provided at the upper end of the second tube and the cable (12) stretched at constant tension during the downward movement of the frame supports the weight of the second tube via the olive.

5. The device as claimed in claim 1 characterized in that the means for causing the second tube (11) to slide in the first one (2) includes in securing one of said tubes to the piston (33) of a hydraulic cylinder and the other to the body (30, 31) of the cylinder, so that the second tube is maintained in the raised position, then slides under the effect of the hydraulic cylinder.

6. A process for lowering and positioning four guide cables having connectors at their bottom ends and connected with a frame having a plurality of arms each having a first fixed vertical tube and a second tube slidable therewithin, said frame having a central connector adapted to be engaged with a well head at an underwater station, said station having a guide column connected with a single guide line and four guide posts having upper ends below the level of the well head; comprising the steps of:

lowering said frame into the sea along the single guide line by a train of rods fixed to the top of the central connector;

stretching the cables under constant tension while limiting relative movement of said cables with respect to said second tubes;

lowering said frame till the frame is angularly oriented and positioned on the well head;

said location of the frame on the well head positioning and spacing the connectors on the bottom ends of the cables a selected distance above the upper ends of the guide posts; and releasing tension in said cables for lowering said connectors to position and lock the connectors in the guide posts.

7. A process as claimed in claim 6 including the step of:

placing weights on said second tubes to drag the cables downwardly on release of tension in the cables.

8. A process as claimed in claim 6 including the steps of:

lowering said cables by exerting a downward force on the second tubes to cause downward movement of the connectors into engagement with the guide posts.

9. In a device for lowering and connecting guide lines associated with a frame adapted to be positioned on a well apparatus and for connecting the guide lines to respective guide posts adjacent the well apparatus including:

a guide frame having a central connector located on a longitudinal axis of the frame for engagement with the well head;

means for angularly orienting said frame with respect to said guide posts;

a plurality of first fixed tubes carried by the frame at its periphery and corresponding in position to the arrangement of the guide posts on said subsea installation;

a plurality of second tubes each slidable in a fixed tube;

a cable passing through each of said associated first and second tubes;

an orientable connector at the end of each cable and at the bottom of the first fixed tube;

means for retaining each cable in the associated first and second tubes;

whereby said second tube accommodates a cable in downward movement of the second tube and cable;

and means providing relative sliding movement between said first and second tubes upon release of tension in said cables.

10. A method for lowering and positioning four guide lines carried by a frame positionable on a well head at a subsea installation having guide posts for connection to said guide lines including the steps of;

lowering said frame toward the well head;

maintaining constant tension on said guide lines during such lowering;

angularly orienting said frame with respect to said guide posts;

positioning said frame on the well head and with selected spacing of the connectors at ends of the cable above the guide posts; and releasing tension in said cables to lower the connectors at end of the cable into engagement with said guide posts.

* * * * *